United States Patent [19]

Mosser et al.

[11] Patent Number: 5,044,984

[45] Date of Patent: Sep. 3, 1991

[54] STACKABLE CONNECTOR ASSEMBLY AND BRACKET THEREFOR

[75] Inventors: Bruce T. Mosser, Spring Grove; Dale F. Pells, Middletown; James R. Weaver, Lancaster, all of Pa.

[73] Assignee: AMP Incorporated, Harrisburg, Pa.

[21] Appl. No.: 542,295

[22] Filed: Jun. 22, 1990

[51] Int. Cl.[5] ..... H01R 9/09

[52] U.S. Cl. ..... 439/540; 439/55; 439/569; 439/931

[58] Field of Search ..... 439/92, 95, 607, 609, 439/610, 608, 540, 108, 931, 569, 570, 562–564; 248/207, 219.4, 231.1, 225.1, 646, 500

[56] References Cited

U.S. PATENT DOCUMENTS

| | | | |
|---|---|---|---|
| 3,601,770 | 8/1971 | Bowley | 439/563 |
| 4,309,856 | 1/1982 | Varnau et al. | 439/540 X |
| 4,440,463 | 4/1984 | Gliha, Jr. et al. | 439/608 X |
| 4,818,239 | 7/1987 | Erk | 439/55 |
| 4,842,528 | 4/1988 | Frantz | 439/80 |
| 4,858,313 | 8/1989 | Bowlin | 439/608 X |
| 4,878,856 | 3/1989 | Maxwell | 439/540 |
| 4,898,546 | 2/1990 | Elco et al. | 439/607 X |
| 4,911,659 | 3/1990 | Viselli | 439/607 X |

*Primary Examiner*—Larry I. Schwartz
*Assistant Examiner*—Julie R. Daulton

[57] ABSTRACT

A one piece bracket (2) for use in stacking, in superposed relationship, first (56) and second (58) shielded multi contact electrical connectors, comprises elongate body, having at one end thereof a top mounting face providing a seat for a grounding flange of the top connector (56) and at the other end thereof a bottom mounting face providing a seat for a flange of the bottom connector (58). A tail part (18) projects from the body (4) and carries a fastening lug in the form of a block (46) having a central bore (52) for receiving a boardlock (100) for securing the bracket (2) to a circuit board (CB). The block (46) projects below the seat for the flange of the bottom connector, so that the lower surface of the block can engage the circuit board when the bracket (2) has been mounted thereon. The elongate body (4) has a through central bore (24) through which one or more fasteners can be passed to secure the flanges to their respective seats. The bracket (2) in the preferred embodiment is symmetrical about a plane including the axes (Z, Z') of the two bores.

26 Claims, 9 Drawing Sheets

STACKABLE CONNECTOR ASSEMBLY AND BRACKET THEREFOR

BACKGROUND OF THE INVENTION

This invention relates to stackable electrical connectors and in particular to a bracket for use in stacking multi-contact electrical connectors in superposed relationship and to a stacked electrical connector assembly comprising such connectors. The invention particularly concerns, the stacking of electrical connectors so that the stack can be mounted on, and secured to, a circuit board with provision being made for electrically connecting metal shields of the connectors to a ground on the circuit board.

There are described in U.S. Pat. No. 4,818,239 and U.S. Pat. No. 4,878,856, means for stacking multi-contact electrical connectors in superposed relationship for mounting on a circuit board, such means comprising a pair of sheet metal brackets for supporting the connectors in their superposed relationship and a pin extension member comprising an insulating housing with electrical contact elements therein, for mating with the top connector of the stack to connect the contact elements thereof to conductors on the circuit board. According to U.S. Pat. No. 4,818,239 the sheet metal brackets each comprise a plate having at opposite ends thereof flanges which are secured to mounting ears at the ends of the connectors. The sheet metal brackets are disposed between the stacked connectors and so do not engage the circuit board and are not intended to be secured thereto. The stack is attached to the circuit board only by inserting pins projecting from the pin extension number and from the bottom connector into plated-through holes in the circuit board. According to U.S. Pat. No. 4,878,856, the sheet metal brackets are right angle brackets, the upright parts of which are secured to respective mounting ears at the ends of the connectors and the transverse parts of which are secured to the circuit board by means of spring metal fasteners.

There is disclosed in U.S. Pat. No. 4,842,528, a multi-contact electrical connector for application to a circuit board, the connector having an outer shield. Ground straps formed integrally with the shield are secured to mounting flanges at opposite ends of the housing of the connector. The ground straps have widened regions which are aligned with holes in the mounting flanges. Solder tails project rearwardly from the contact elements in the housing and are rectangularly bent so as to extend downwardly beyond the housing through slots in a solder tail spacer plate which projects rearwardly therefrom.

The present invention is directed towards the provision of means for stacking shielded multi-contact electrical connectors in superposed relationship with the use of a minimum of separate parts and which at the same time enable the connectors to be positively secured together to provide a unitary and rigid stacked connector assembly which can be safely applied to a circuit board. The stacking means serving to connect the shields of the connectors to ground conductor means on the circuit board when the assembly has been applied thereto, as well as serving to secure the assembly to the circuit board.

SUMMARY OF THE INVENTION

According to one aspect of the invention, there is provided, a one piece bracket for use in stacking, in superposed relationship, first and second shielded multi-contact electrical connectors having apertured flanges projecting from opposite ends thereof. The bracket comprises an elongate body having at one end thereof a top mounting face for receiving a flange of the first connector and at the other end thereof a bottom mounting face for receiving a flange of the second connector, the body defining a bore opening into each of said faces for receiving a fastener for securing a respective flange thereto. The bracket further comprises a block projecting from the body and below the bottom face thereof to provide a shoulder bounding the bottom face, the block defining a bore spaced laterally from the body for receiving means for fastening the bracket to the circuit board.

A pair of brackets can be used to stack the connectors so as to provide a rigid and unitary stacked connector assembly. The brackets may provide an electrical path between the ground strap of the connectors which are electrically connected to the shields thereof and the means for fastening the bracket to the circuit board. The fastening means will normally be in the form of an electrically conductive boardlock for insertion in holes in the board to engage ground conductor means thereon.

Each of the brackets, which may be identical, preferably has a plane of symmetry such that essentially only one part must be manufactured and either bracket can be used at either end of the assembly.

The block of each bracket may be provided with a channel for receiving an end of a spacer comb having a positive locking feature for contact tails of the first or upper connector.

Since the said block of each bracket projects below the bottom mounting face thereof, a recess is provided for receiving the respective flange of the second or lower connector, thereby enabling the bottom face of the block to lie against the circuit board when the stacked connector assembly has been applied thereto.

Another aspect of the invention, consists in a stacked electrical connector assembly, for mounting on a circuit board, comprising a pair of brackets serving to secure top and bottom multi-contact shielded electrical connectors superposed in relationship.

DESCRIPTION OF THE PREFERRED EMBODIMENT

Figure 1:
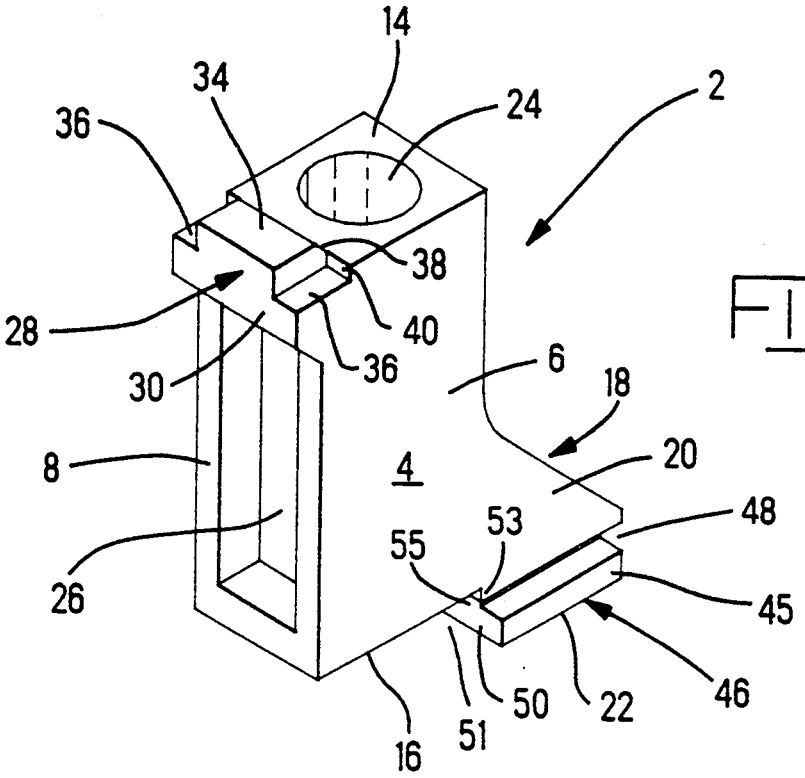
FIGS. 1 to 4 are different isometric views of a bracket for use in stacking multi-contact electrical connectors.
Figure 2:
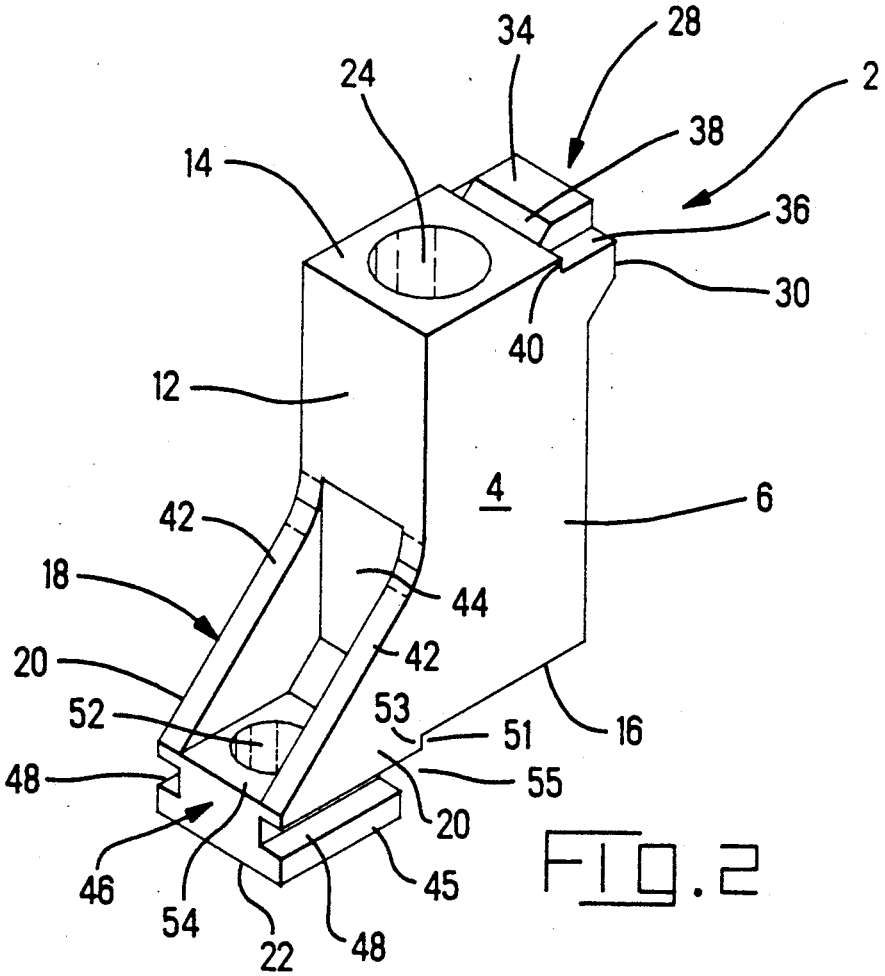
Figure 3:
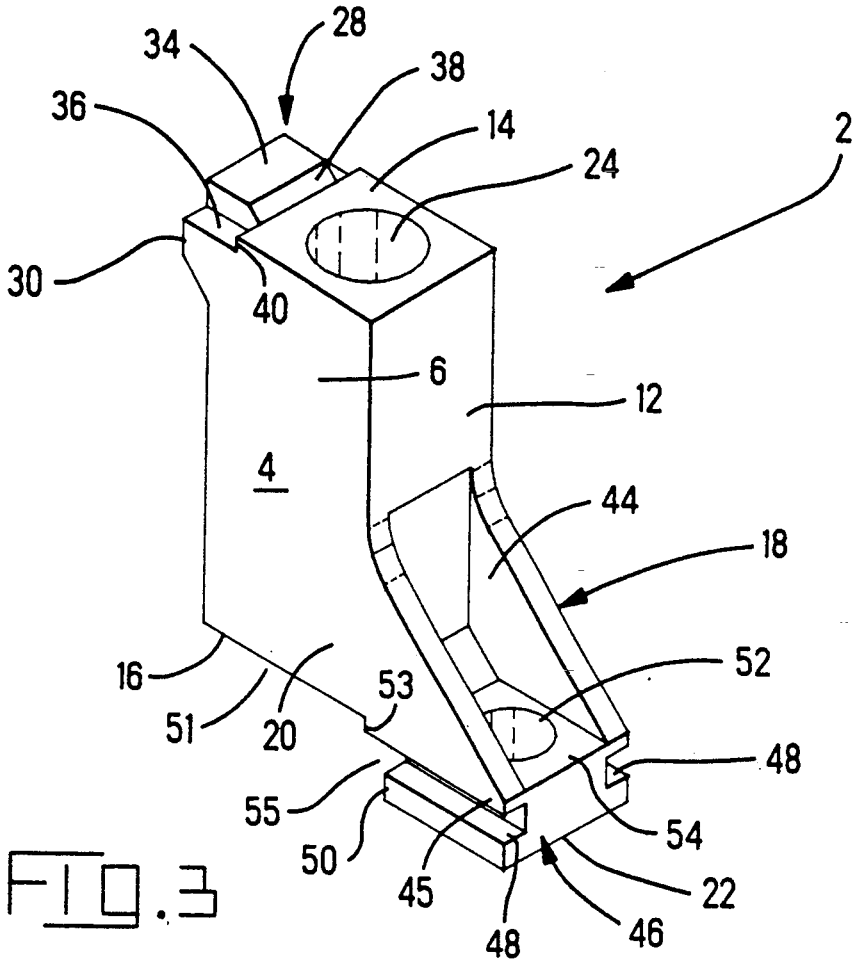
Figure 4:
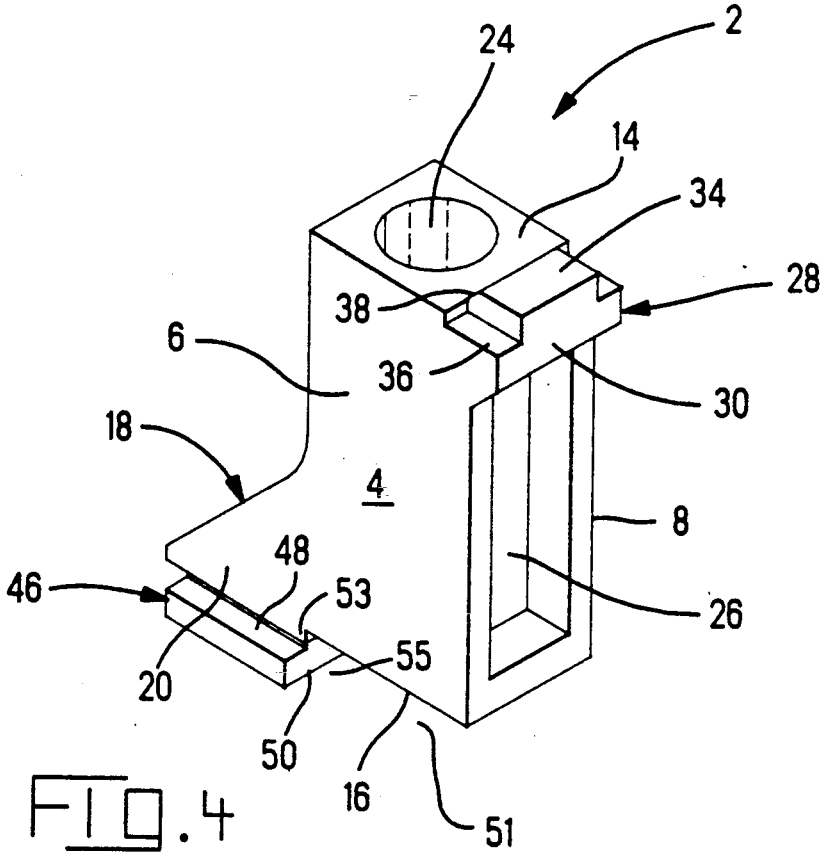
Figure 5:
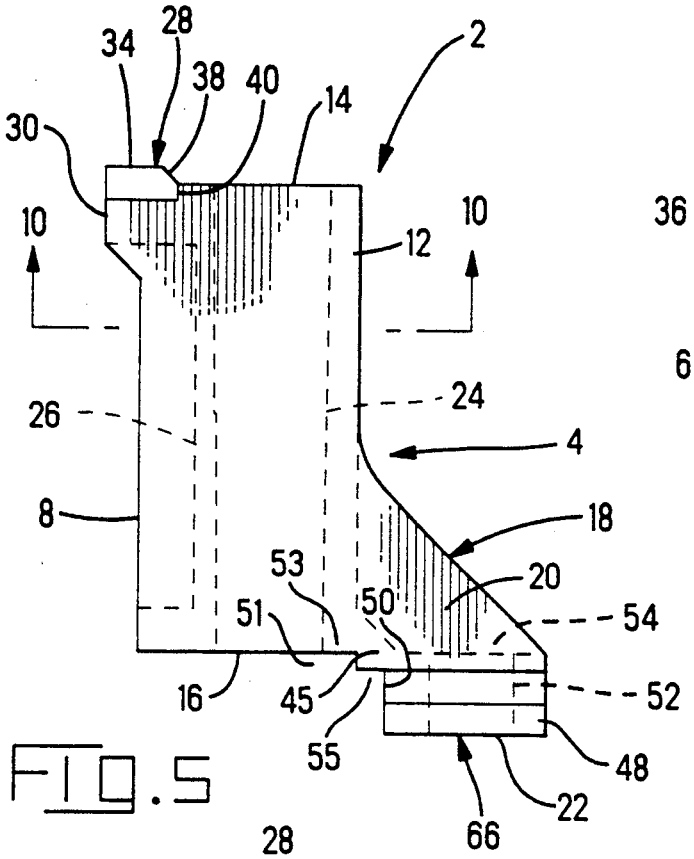
FIGS. 5 to 9 are a side view, a front end view, a rear end view, an underplan view, and a top plan view, respectively, of the bracket shown in FIGS. 1 to 4.
Figure 6:
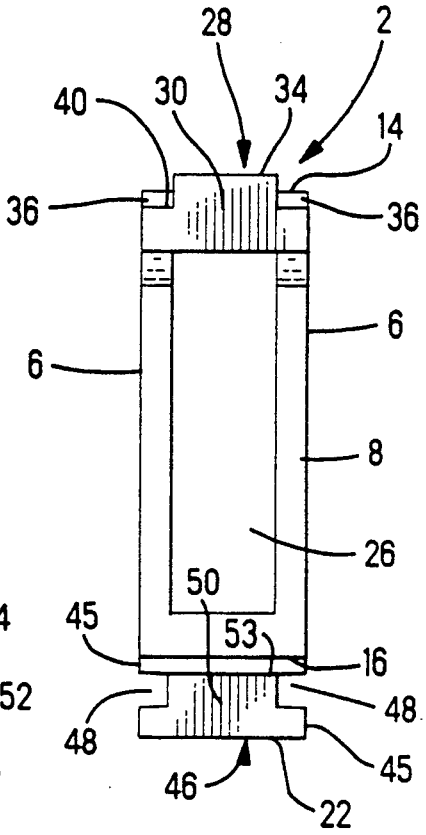

One of a pair of brackets 2 for use in stacking a pair of elongate multi-contact electrical connectors will now be described with reference to FIGS. 1 to 10. In the preferred embodiment, each bracket is diecast zinc. However, other applications may utilize metalized containing conductive particles or metal coated plastic. If a grounding function is not required, such as when stacking unshielded connectors, a molded plastic bracket in accordance with the present invention will suffice.

Each bracket 2, which has been made in one piece from a suitable material for the application, comprises an elongate, upright body 4 of overall rectangular cross section, having a pair of parallel identical flat side faces 6, a flat front face 8, a flat rear face 12, a flat top face 14 and a flat bottom face 16. There extends rearwardly from rear face 12, a tail portion 18 having identical parallel side faces 20 each of which is flush with, and merges with, a respective face 6 of the body 4, and a bottom face 22.

The body 4 is formed with a central fastener receiving circular cross section axial bore 24 opening onto both of the faces 14 and 16 and extending normally thereof. Bore 24 may extend into body 4 from each face 14 and 16 or may extend completely through body 4. There opens into the front face 8 of the body 4 an axially extending, elongate, blind recess 26 which provides a lock screw clearance area. The upper part of the recess 26 extends into the bottom of a flange keying and alignment seat 28 which projects from the body 4 forwardly of, and overhangs, the face 8. The seat 28 has a forward face 30 and an adjacent top face 34 which is parallel with, but is raised slightly above, the top face 14. There opens into the face 34, on either side thereof, a rectangular cross section, keyway recess 36, each of these recesses opening into the front face 30 and into a respective side face 6 of the body 4. The seat 28 has a rear face 38 which slopes down from the face 34 to adjoin a vertical forward, top, abutment edge 40 of the body 4, which edge defines the rear ends of the recesses 36.

The tail portion 18 comprises a pair of rigid rearwardly sloping triangular shaped cheeks 42 presenting the side faces 20 and cooperating to define the sides of a rearwardly opening blind access slot 44 having a base provided by a fastening lug in the form of a rectangular block 46 projecting below the bottom face 16 of the body 4 and presenting the bottom face 22 of the tail portion 18, which is parallel with the face 16 and is spaced therebelow. There opens into either side face 45 of the block 46, a through, rectangular section, spacer comb receiving channel 48 extending parallel to the faces 16 and 22 and below the former. The block 46 has a forward abutment face 50 bounding the rear end of the face 16, and providing a flange abutment shoulder and defining a recess 51 in cooperation with the face 16. Between the faces 16 and 50 is a shoulder 53 providing a clearance space 55 for a spacer comb locking feature. There extends through the block 46, parallel with the bore 24, and in alignment therewith, a circular cross section locking clip receiving bore 52 which opens into the upper face 54 of the block 46 and into its lower face 22.

The bracket 2, in the preferred embodiment, is exactly symmetrical about a central longitudinal plane including the axis Z and Z', respectively (FIG. 8), of the circular bores 24 and 52, the said plane bisecting the faces 8, 12, 14 and 16. The use of a pair of brackets 2 to stack elongate, multi-contact top and bottom standard electrical connectors 56 and 58 respectively, in superposed relationship will now be described with reference to FIGS. 11 to 14B.

Each connector 56 and 58, which may be either a pin or a receptacle connector, and may be of the kind disclosed in U.S. Pat. No. 4,842,528 which is incorporated herein by reference, comprises an elongate, insulating housing 60 having a front face 62 into which open a plurality of cavities 64 arranged in two superposed rows and each containing an electrical contact element 66, which may be either a pin or a receptacle contact element. The forward part of the housing 60 is surrounded by a hood 68 of an outer electrically conductive metal shield 70 having a mounting ear 72 at each end formed with a tapped hole 74 therethrough. The connectors 56 and 58 are identical, excepting that the contact elements 66 of the connector 56 have long rectangularly bent contact tails 76 extending from the rear face of the housing 60 and depending therebelow, whereas the contact elements 66 of the connector 58 have short rectilinear contact tails 78 projecting downwardly through a spacer comb 77 on the housing 60 of the connector 58. The contact tails of each connector 56 and 58 are arranged in two juxtaposed offset rows.

Figure 14:
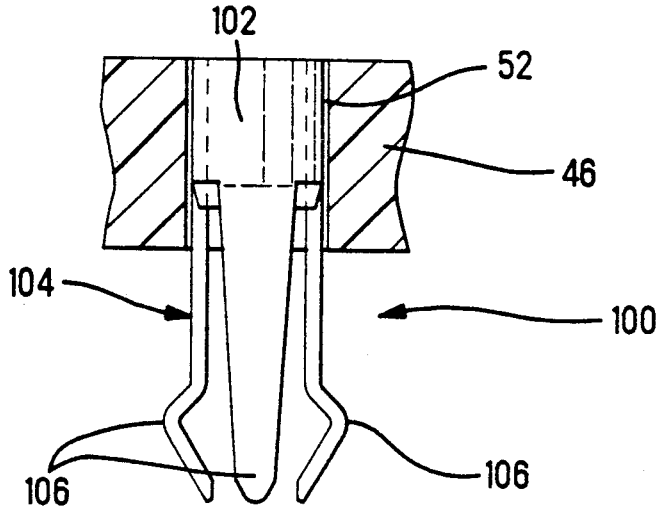
FIG. 14 is an enlarged fragmentary, sectional view illustrating a detail of FIGS. 11 to 13.
Figure 14A:
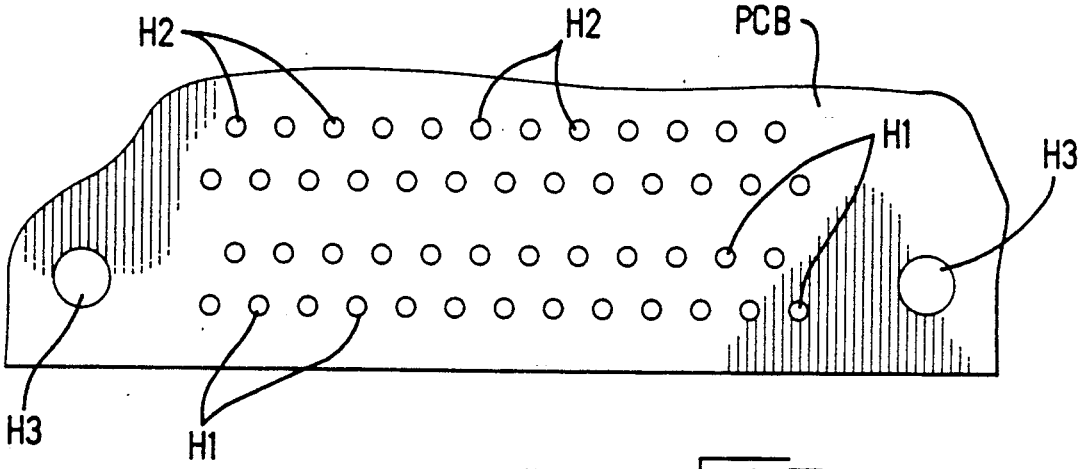
FIG. 14A is a fragmentary plan view illustrating the layout of holes in a printed circuit board on which the stacked connector assembly is to be mounted.
Figure 14B:
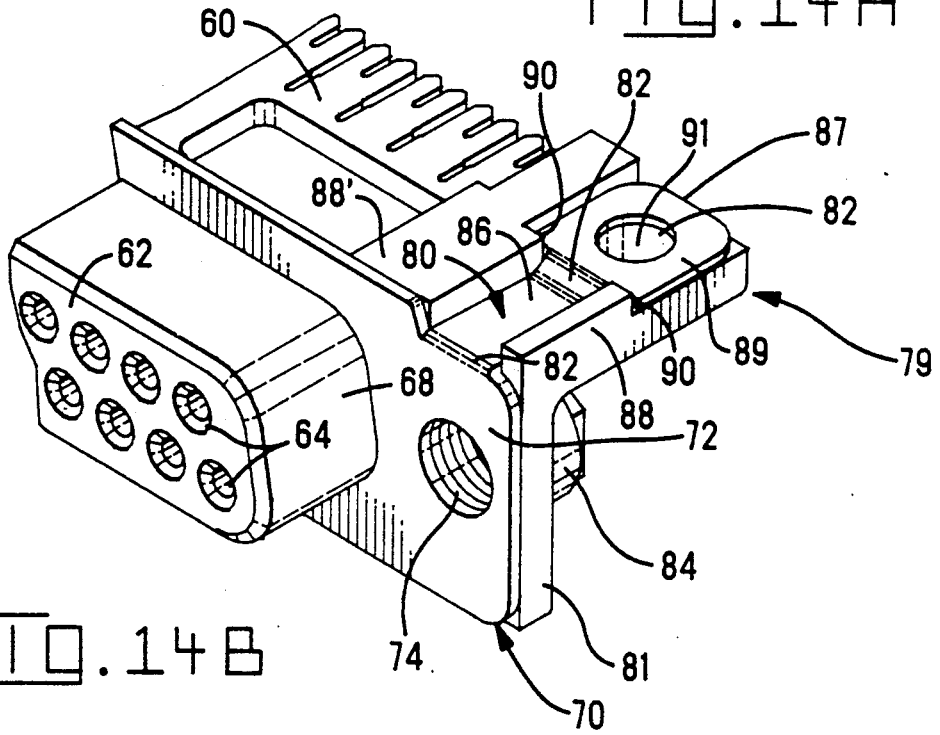
FIG. 14B is a fragmentary isometric view of an end portion of one of said connectors.

As best seen in FIG. 14B, the housing 60 of each connector 56 and 58 is formed at each end with a mounting flange 79 enclosing laterally, a metal grounding member in the form of a ground strap 80, formed integrally with and projecting rearwardly from, a respective mounting ear 72 of the shield 70. The shield 70 is secured to the housing 60 by means of lock screws 84 extending through mounting ears 81 of the housing 60 and being screwed into holes 74. Each strap 80 comprises a plate 86 connected at one end to the respective ear 72 and at its other end, by way of a offset 82, to a widened region 89 having a central fastener receiving aperture 92 near the free end 87 of the respective mounting flange 79. A pair of opposed ribs 88 and 88' depending from the flange 79 and housing 60, respectively, on either side of the plate 86, each extends from a position proximate to the shield 70 substantially towards the free end 87 and terminates proximate offset 82 in a shoulder 90 engaging the offset 82. The rib 88' has an extension enclosing the inward side of the widened region 89. Each flange 79 has a through hole 91 aligned with the hole 92 in a respective widened region 89.

Figure 10:
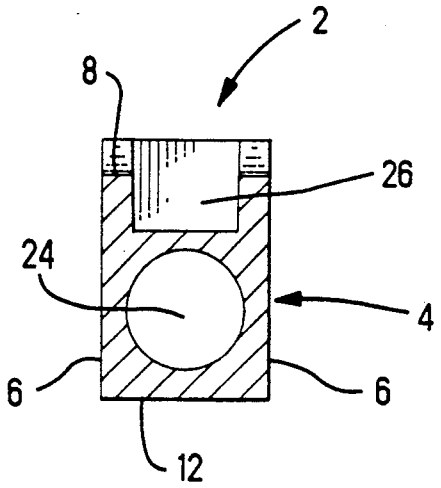
FIG. 10 is an enlarged cross sectional view taken on the lines 10—10 of FIG. 5.
Figure 10A:
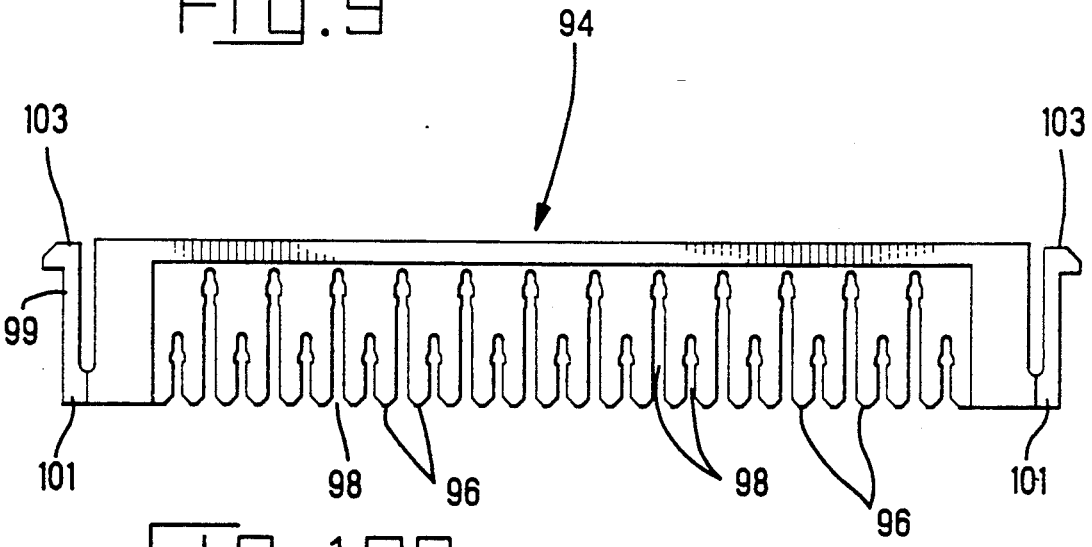
FIGS. 10A and 10B are a plan view and a side view, respectively, of contact tail spacer comb, drawn to a smaller scale than FIGS. 1 to 10.
Figure 10B:
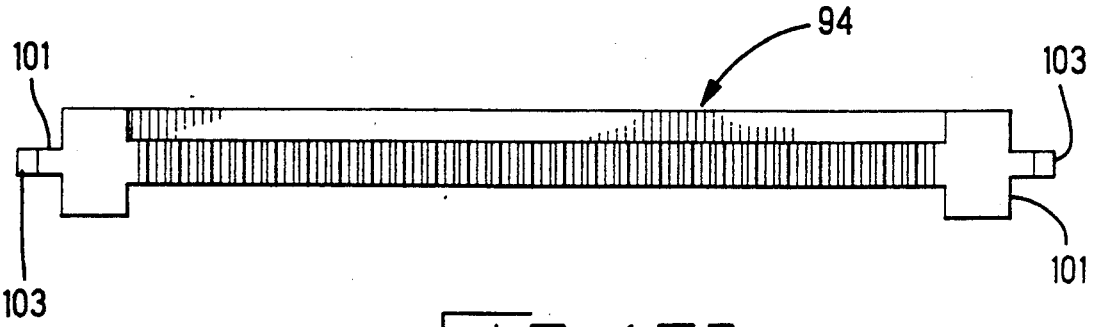

There is associated with the pair of brackets 2, a further contact tail spacer comb 94 (shown in FIGS. 10, 10A and 13) formed with a row of alternate long and short contact tail guide slots 96 and 98, respectively, for receiving the contact tails 76 of the forward and the rear row thereof, respectively. The comb 94 has at each end thereof a resilient latch arm 99 on a reduced cross section part 101, the arm 99 terminating in a latching head 103. Also, there is associated with each of the brackets 2 a resilient boardlock 100, which may be constructed according to the teaching of U.S. Pat. No. 4,842,552 which is incorporated herein by reference. As best seen in FIG. 14, each boardlock 100 comprises a resilient collar 102 which fits tightly into the respective bore 52 of the block 46 of the bracket 2 and from which depends a locking portion 104 terminating in outwardly bowed locking springs 106, depending below the block 46.

Figure 7:
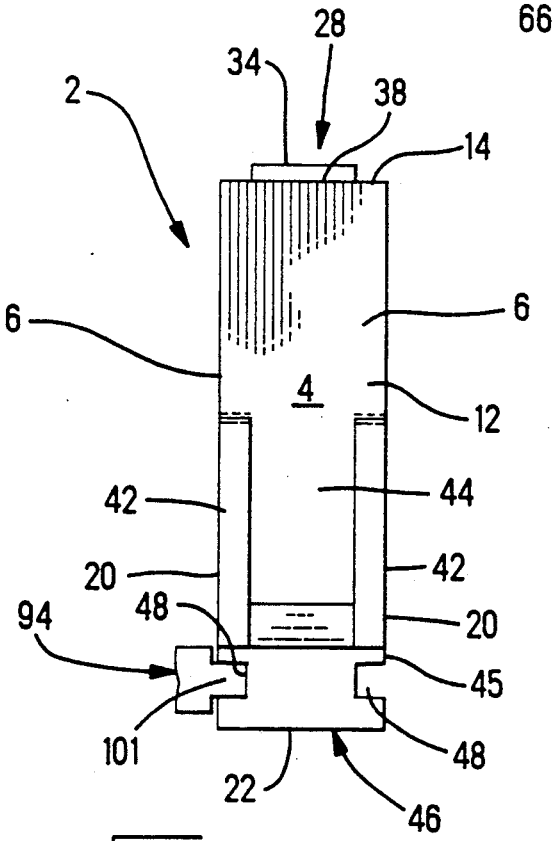
Figure 8:
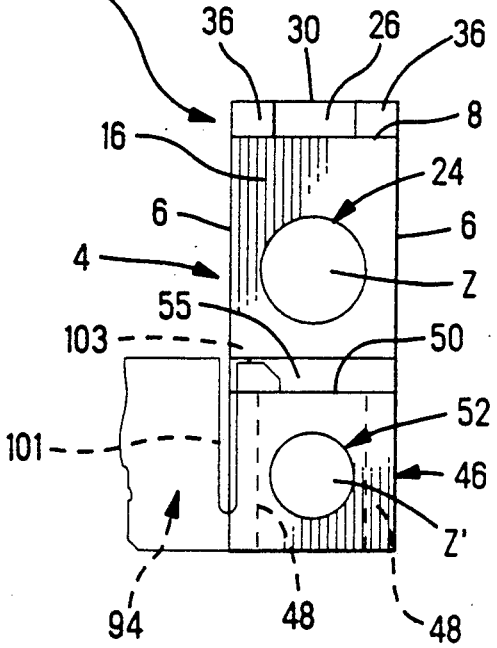
Figure 9:
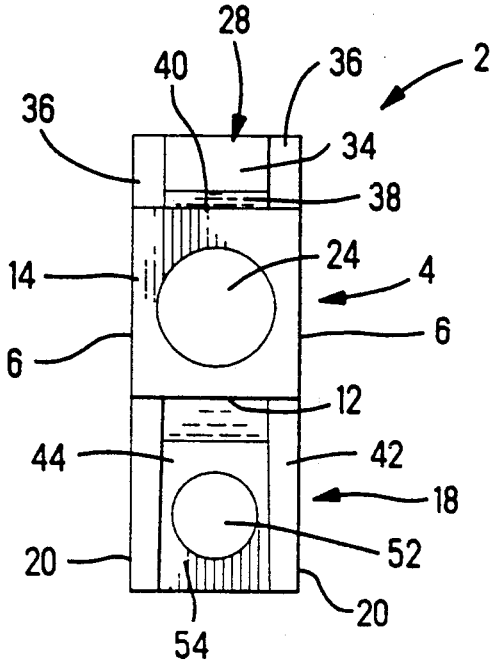
Figure 13:
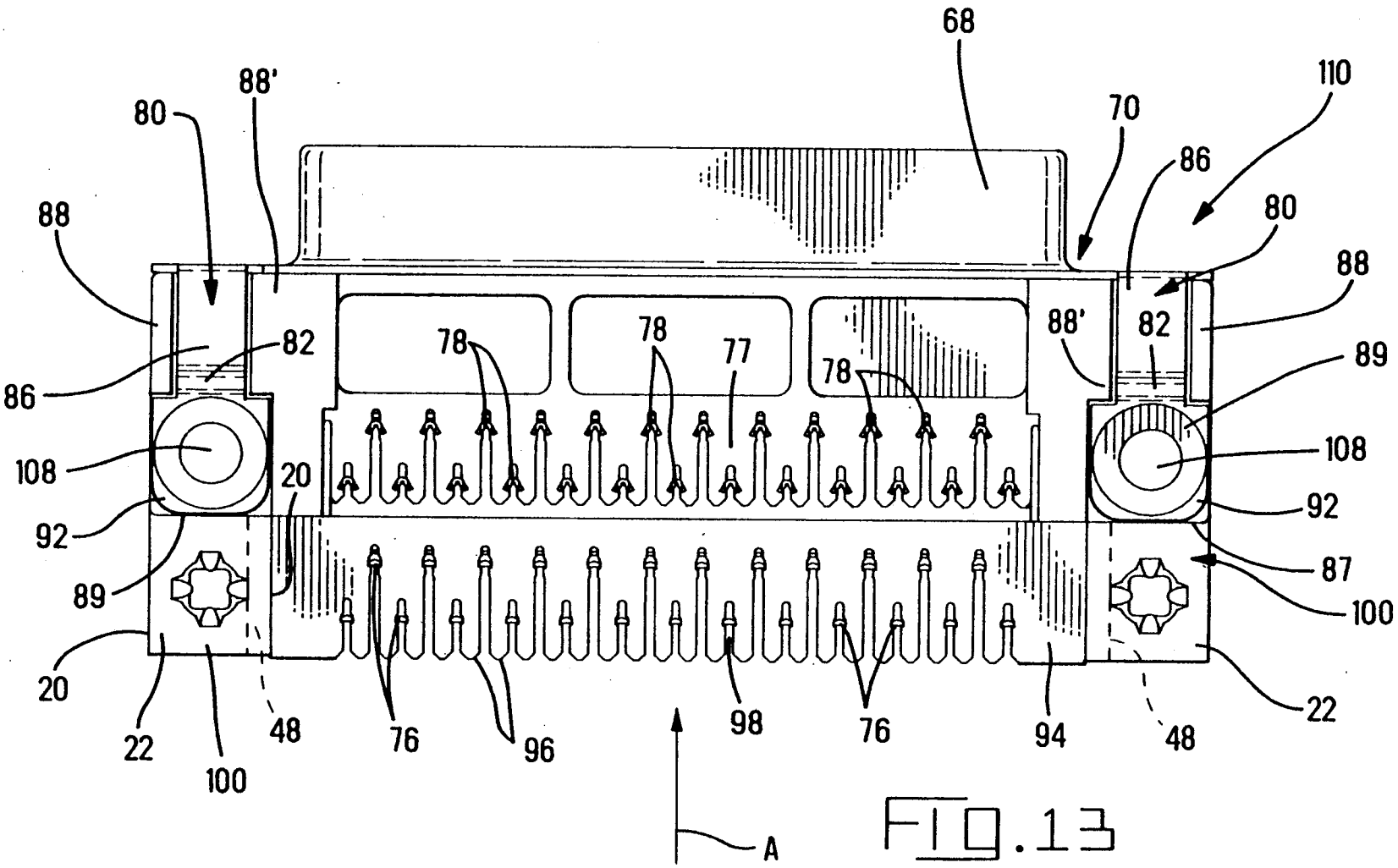

With the two brackets 2 located in spaced, aligned, relationship, with their faces 6 parallel and their tail portions 18 projecting in the same direction, the comb 94 is assembled to the brackets 2, by inserting, in the direction of the arrow A in FIG. 13, its end parts 101 into the two facing ones of the channels 48 of the blocks 46 of the brackets 2 as shown in FIGS. 7, 8 and 13. As shown in FIG. 8, each latching head 103 is, after being laterally deflected by engagement with the base of the respective channel 48, received in the respective clearance space 55, the head 103 snapping into engagement with the shoulder 50 as the arm 99 resides, to lock the comb 94 against rearward movement.

Figure 12:
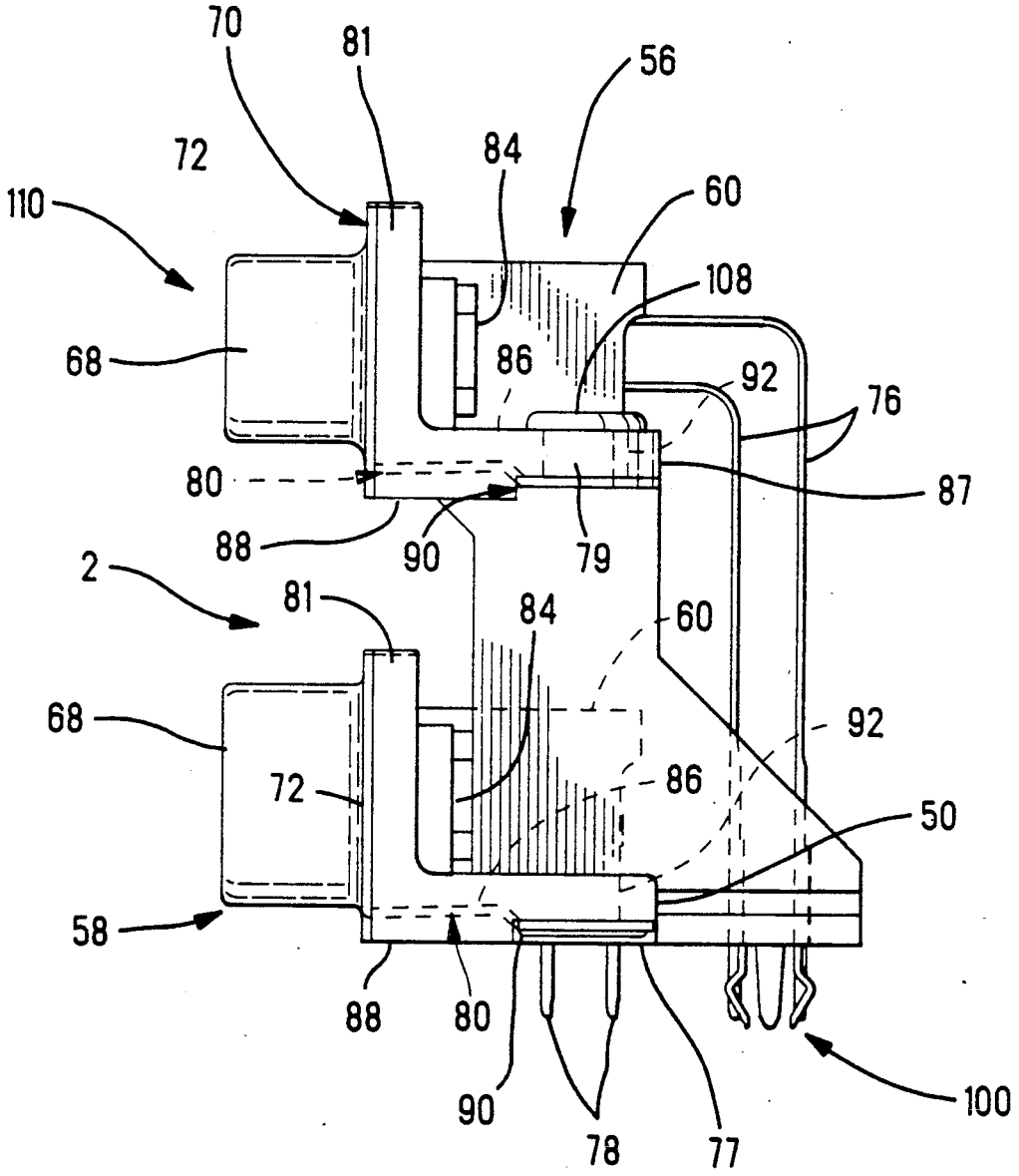

The bottom connector 58 is then assembled to the brackets 2 by inserting each of its mounting flanges 79 under the bottom face 16 of the body 4 of a respective bracket 2 until the free end 87 of the flange 79 engages the abutment face 50 of the block 46 of said respective bracket 2, as shown in FIG. 12, whereby the hole 92 in the widened region 89 and the hole 91 in the flange 79 are aligned with the bore 24 in the body 4 of that bracket 2, and the comb 94 is blocked against forward movement by the free end 87 of the flange 79. The widened region 89 of each ground strap 80 of the connector 56 lies against the face 16 of the respective bracket 2, the flange 79 being received in the recess 51 thereof and keying flange 28 received between ribs 88 and 88'. Flange 28 received between ribs 88 and 88' stabilizes bracket 2 relative to connector 56. The contact tails 78 of the connector 58 project below the brackets 2, the part of the housing 60 of the connector 58 between the flanges 79 being received between the brackets 2. The lock screws 84 are prevented from stubbing against the brackets 2 by virtue of the recesses 26.

The top connector 56 is then positioned downwardly onto the tops of the brackets 2 so that the ribs 88 and 88' at each end of the connector 56 straddle the face 34 of the seat 28 of the respective bracket 2, whereby each rib 88 and 88' lies in a respective recess 36 with its shoulder 90 against the edge 40 of the body 4, at the rear end of the recess 36 as shown in FIG. 12, whereby the hole 92 in each widened 89 of the connector 56 and the hole 92 in each flange 7 is aligned with the bore 24 in the body 4 of the respective bracket 2. In each case, the plate 86 is engaged against the face 34, the offset 82 is engaged against face 38 and the widened region 89 is engaged against the face 14, of the respective bracket 2. During the downward movement of the connector 56, each tail 76 thereof is inserted into its respective slot 96 or 98, whereby the tails 76 project beneath the brackets 2, the part of the housing 60 between the flanges 79 of the connector 56 being received between the brackets 2. Since the tails 76 are flexible, the comb 94 is needed in order to locate them in their required constantly spaced positions.

A fastener 108 is now inserted through the hole 91 in flange 79 and the hole 92 in the widened region 89 at each end of the connector 56, through the aligned bore 24 of the respective bracket 2, and through the hole 92 in widened region 89 as well as the hole 91 in the flange 79 at each end of the connector 58. Fastener 108 positively secures the connectors 56 and 58 to the brackets 2 in their stacked, superposed relationship, with the shields 70 of the connectors 56 and 58 electrically connected to the boardlocks 100 by way of the ground straps 80, the fastener 108 and the brackets 2.

Figure 11:
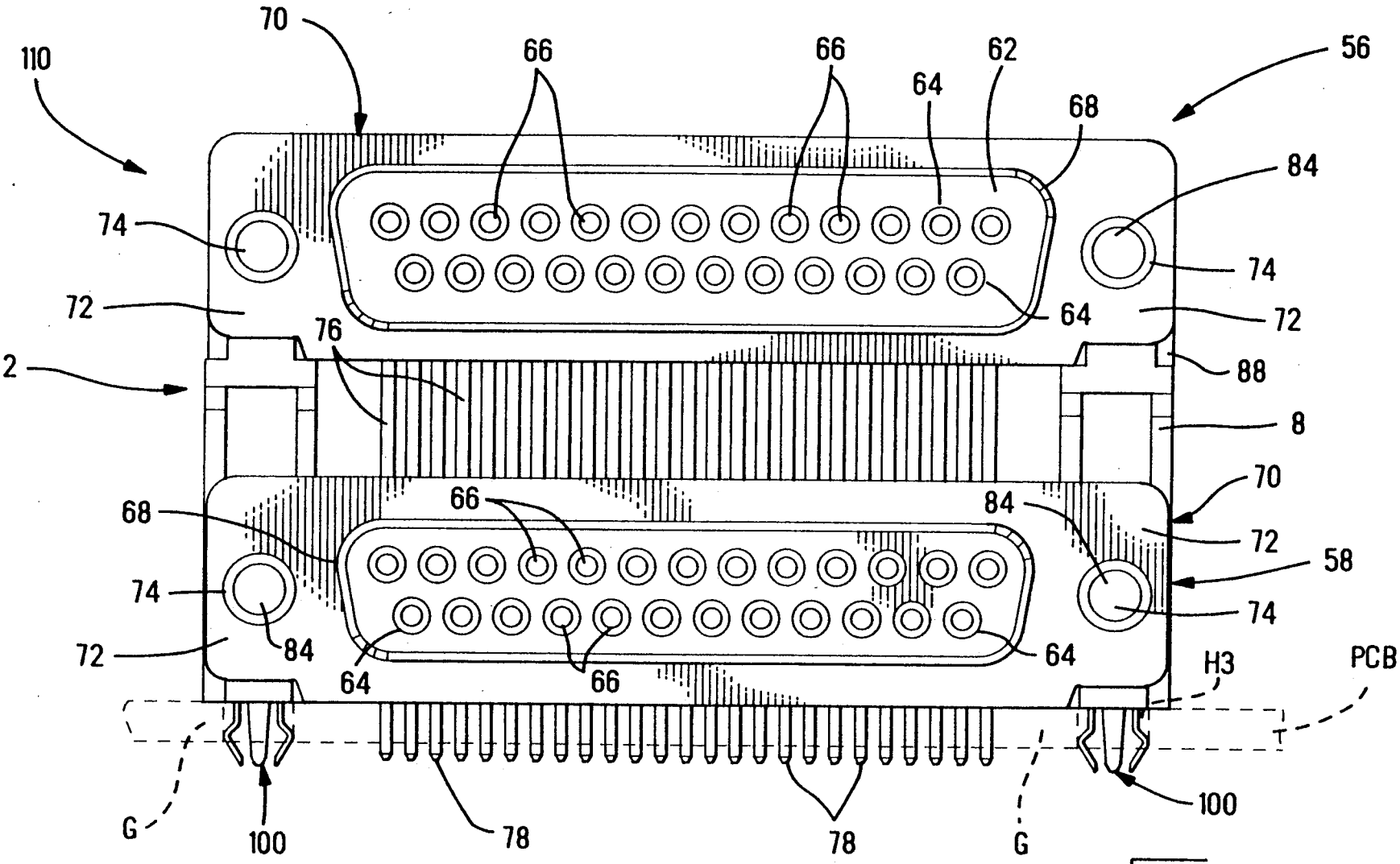
FIGS. 11 to 13 are a front view, a side view, and an underplan view, respectively, of a stacked electrical connector assembly comprising a pair of the brackets according to FIGS. 1 to 10, said spacer comb and a pair of multi-conductor electrical connectors, FIGS. 11 and 13 being drawn to a smaller scale than FIGS. 1 to 10.

The rigid and unitary connector assembly 110, so provided, is now ready for mounting to a circuit board CB which is shown in broken lines in FIG. 11 and in fragmentary form in FIG. 14A. The CB is formed with a first pair of rows of holes H1 each for receiving a contact tail 76 of the top connector 56 and a second pair of rows of holes H2 each for receiving the contact tails 78 of the bottom connector 58. The CB is provided on either side of the rows of holes H1 with a large diameter hole H3 for receiving a respective boardlock 100. The assembly 110 is mounted to the CB by inserting the clips 100 into the holes H3 so that the bowed locking springs 106 of the clips 100 engage beneath the CB so as to secure the assembly 110 thereto, with the springs 106 engaging ground conductors G on the underside of the CB thereby electrically to connect the shields 70 of the connectors 56 and 58 to ground. The tails 76 and 78 project through the holes H1 and H2, respectively. With the assembly 110 so secured to the CB, the boardlocks 100 are soldered to the conductors G and the contact tails to signal conductors (not shown) on the CB, for example by means of a wave soldering operation.

The rigid and unitary assembly 100 can conveniently be mounted to the CB by means of a pick and place robot, for example.

Figure 15:
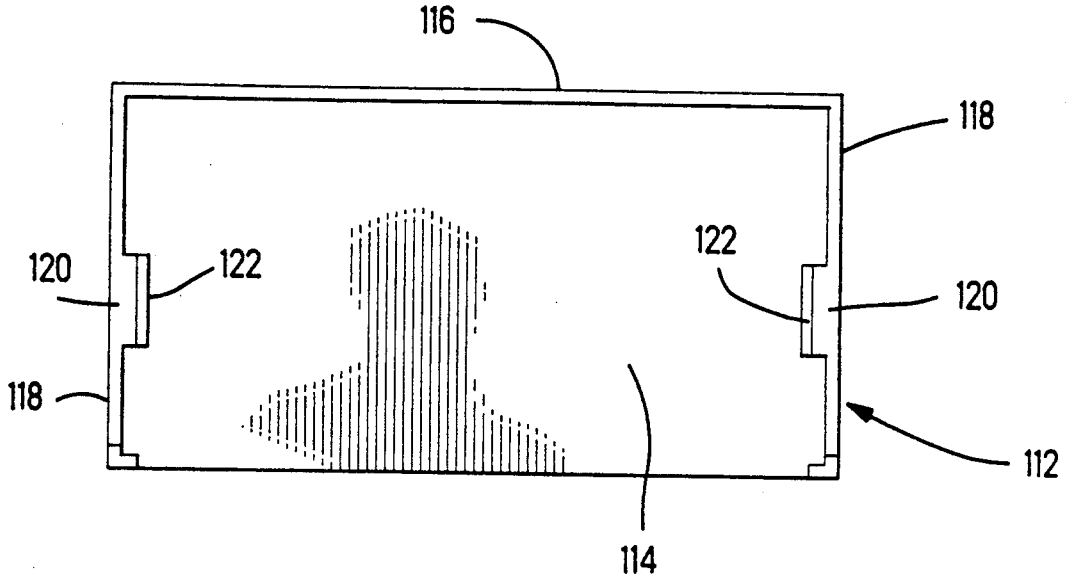
FIGS. 15 to 17 are a plan view, an end view, and a side view, respectively, of a cover for the said assembly.
Figure 16:
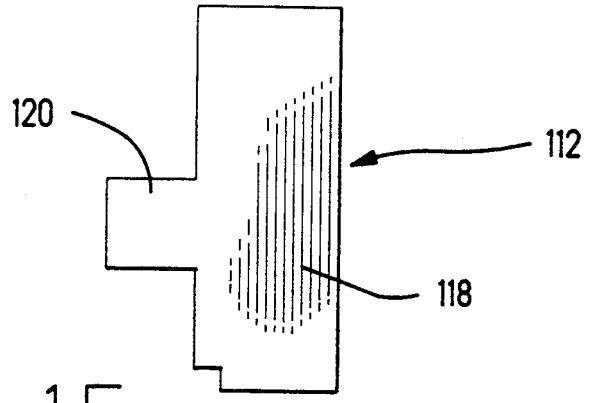
Figure 17:
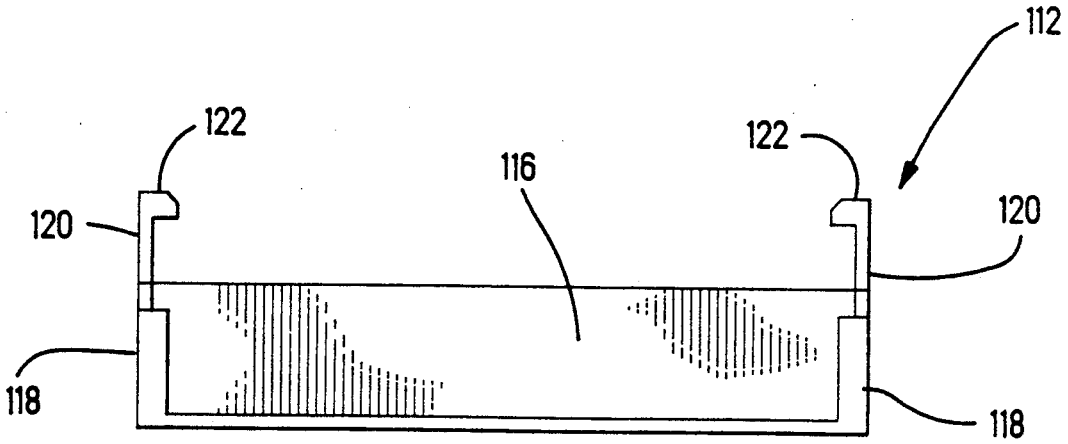

The assembly 110 may be provided with a snap-on cover 112 (FIGS. 15 to 17) comprising a three sided rectangular frame having a rear wall 114 and a top wall 116 for covering the connectors 56 and 58, and side walls 118 for embracing the brackets 2. There extend from the side walls 118, latch arms 120 terminating in heads 122 for latching about front faces of the brackets 2.

Since the brackets 2 are identical and are symmetrical about the said plane including the axis (Z) and (Z'), either of the brackets 2 can be used at either end of the assembly 110.

Instead of inserting a single fastener through each bore 24, to secure the connectors to the brackets 2, a separate fastener could be inserted into each end of each bore 24.

The blocks 46 may each be provided with more than one boardlock, being appropriately dimensioned to this end.

What is claimed is:

1. A bracket for use in stacking, in superposed relationship, first and second electrical connectors having apertured mounting flanges projecting from opposite ends thereof, said bracket comprising:

an elongate tubular body having at one end thereof a top mounting face for receiving a bottom face of amounting flange of the first connector and at an end of the body opposite to said one end, a bottom mounting face, the body defining a first bore extending continuously through the body and opening into each of said faces for receiving fastener means for securing said mounting flanges thereto; and a fastening block projecting from said body and below said bottom face thereof to provide a shoulder bounding said bottom face and co-operating with said bottom face to define a recess for receiving a mounting flange of said second connector, said fastening block defining a second bore spaced laterally from said body for receiving means for fastening said bracket to a circuit board.

2. A bracket as recited in claim 1, wherein a side of said fastening block is formed with a channel extending parallel to said bottom face and therebelow, for receiving and end of a contact tail spacer comb.

3. A bracket as recited in claim 2, wherein the bracket is symmetrical.

4. A bracket as recited in claim 1, further comprising a seat proximate to said top face of a body and defining a pair of parallel spaced channels extending parallel to, and below said top face, for receiving respective ribs depending from the mounting flange of said first connector.

5. A bracket as recited in claim 4, wherein said seat comprises a flat upper face, said channels extending on either side of said upper face and each such channel terminating in a stop surface adjacent to the top face of the body.

6. A bracket as recited in claim 5, wherein said stop surfaces are defined by a shoulder adjacent to said top face, a surface which is downwardly inclined towards said shoulder connecting the base thereof to said flat upper surface.

7. A bracket as recited in claim 1, wherein the bracket is diecast zinc.

8. A bracket as recited in claim 1, wherein the bracket is molded plastic.

9. A bracket as recited in claim 8 wherein the plastic is metalized.

10. A bracket as recited in claim 8 wherein the plastic is metal coated.

11. A bracket as recited in claim 1, wherein said first bore is a bore extending parallel to the bore defined by said fastening lug, each bore having a longitudinal axis extending lengthwise of said body and said bracket having a plane of symmetry which includes those longitudinal axes.

12. A bracket as recited in claim 1, wherein said fastening block is of overall rectangular cross section, said body also being of overall rectangular cross section, said body having a front face, identical side faces and a rear face, all of which are adjacent to said top and bottom faces, said block being connected to said rear face and having a bottom face which is parallel to the top and bottom faces of said body, said shoulder extending at right angles to said top and bottom faces, a seat proximate to said front face comprising an upper face parallel to, and spaced above, said top face and a pair of recesses opening into said front and side faces, an abutment edge extending normally from said top face forwardly thereof and rearwardly of said recesses, said block having side faces defining a pair of identical parallel channels, each such channel opening into a respective side face of the block and into a forward and a rear face thereof, said bracket having a plane of symmetry bisecting the front, the rear, the top and the bottom faces of said body.

13. A bracket as recited in claim 12, Wherein said block is connected to said body by means of a pair of identical cheeks projecting from said rear face of the body and tapering towards said block.

14. A bracket as recited in claim 12, wherein a further shoulder connecting the bottom face of said body to the shoulder defined by said block, defines a relief area for receiving a head of a latch arm on a contact tail spacer comb received in said parallel channels.

15. A bracket as claimed in claim 12, wherein said body is formed with a longitudinal recess terminating proximate to said bottom face thereof and opening into said front face thereof.

16. A one piece bracket for use in stacking multicontact electrical connectors, the bracket comprising an elongate, tubular rectilinear, overall rectangular cross section body having parallel side faces, a front face, and a rear face and top and bottom flange seats adjacent to said side faces, said front face and said rear face and a through central bore opening into both of said top and bottom seats; and a fastening block projecting from said rear face and depending below said bottom seat to define a shoulder extending normally thereof, said block defining a through bore which is parallel with said central bore and is spaced rearwardly of the rear face of said body, said shoulder being substantially coplanar with said rear face to define in cooperation with said bottom seat a substantially rectangular recess, said block being recessed to receive one end of a contact spacer comb.

17. A stacked electrical connector assembly for mounting on a circuit board, the assembly comprising;

top and bottom, elongate, multi-contact electrical connectors, arranged in superposed parallel relationship, each comprising an insulating housing containing at least one row of electrical contact elements having contact tails projecting from the housing, the contact tails of the top connector projecting from a rear face of the housing thereof and being rectilinearly bent so as to extend below bottom faces of both housings, the contact tails of the bottom connector projecting from a bottom face thereof, each housing having first and second flanges having an aperture for receiving a fastener, the flanges of each connector projecting from opposite ends of the housing thereof;

first and second brackets arranged in spaced relationship longitudinally of said connectors and each bracket comprising an upright body having an upper seat to which a respective one of the first and second flanges of said top connector is secured, and a lower seat to which a respective one of the first and second flanges of the bottom connector is secured a fastening lug projecting from the body of each bracket below the lower seat thereof to define in cooperation therewith, a recess for receiving said respective flange of the bottom connector, a fastener depending from the fastening lug of each bracket for securing the bracket to the circuit board, whereby the contact tails of both of the connectors will extend through holes in the circuit board.

18. An assembly as recited in claim 17, wherein the fastening lug of each bracket is a block having a channel therein, a contact tail spacer plate extending between said brackets having opposite ends each of which is lodged in a respective one of said channels, the contact tails of the top connector extending through holes in said spacer plate, each end of the spacer plate having a latching head engaged with a surface of said block and the respective flange of the bottom connector restraining movement of said latching head away from said surface.

19. An assembly as claimed in claim 17, wherein each bracket is a one piece metal casting, said brackets being identical and said body having a through axial bore receiving fastening means securing the respective grounding flanges of said top and bottom connectors to said upper and lower seats of the body, said fastening lug having a through bore for receiving said fastener for fastening said bracket to said circuit board, said bores being parallel to one another, said bracket having a plane of symmetry including the longitudinal axis of each bore.

20. A stacked electrical connector assembly as recited in claim 17, wherein the electrical connectors further comprise an electrically conductive shield having a ground strap proximate at least one flange, said ground strap engaging a respective bracket, said bracket being electrically conductive, whereby the shield is electrically commoned with the bracket for connection to a ground on the circuit board.

21. An assembly as recited in claim 17, wherein the upper seat of each bracket comprises a flat surface into which opens a first bore, the aperture of the respective flange of the top connector engaging said flat surface and being electrically connected thereto by means of a fastener extending through that flange and that aperture and into said bore, a pair of keyways in the body of the bracket extending parallel to and below said flat surface each keyway receiving a rib depending from said flange, a surface of said bracket, extending between said keyways above said flat surface, engaging the ground strap of the grounding flange between the aperture thereof and the shield of the top connector.

22. A stacked electrical connector assembly as recited in claim 20, wherein the bracket is diecast zinc.

23. A stacked electrical connector assembly as recited in claim 20, wherein the bracket is metalized plastic.

24. A stacked electrical connector assembly as recited in claim 20, wherein the bracket is metal coated plastic.

25. A bracket for use in stacking, in superposed relationship, fist and second electrical connectors having apertured mounting flanges projecting from opposite ends thereof, said bracket comprising:

an elongate body having at one end thereof a top mounting face for receiving a bottom face of a mounting flange of the first connector and at an end of the body opposite to said one end, a bottom mounting face, the body defining a bore opening into each of said faces for receiving fastener means for securing said mounting flanges thereto; and a fastening block projecting from said body and below said bottom face thereof to provide a shoulder bounding said bottom face, said fastening block defining a bore spaced laterally from said body for receiving means for fastening said bracket to a circuit board, wherein a side of said fastening block is formed with a channel extending parallel to said bottom face and therebelow, for receiving an end of a contact tail spacer comb.

26. A bracket for use in stacking, in superposed relationship, first and second electrical connectors having apertured mounting flanges projecting from opposite ends thereof, said bracket comprising:

an elongate body having at one end thereof a top mounting face for receiving a bottom face of amounting flange of the first connector and at an end of the body, opposite to said one end, a bottom mounting face, the body defining a bore opening into each of said faces for receiving fastener means for securing said mounting flanges thereto; and a fastening lug projecting from said body and below said bottom face thereof to provide a shoulder bounding said bottom face, said fastening lug defining a bore spaced laterally from said body for receiving means for fastening said bracket to a circuit board, a seat proximate to said top face of a body defining a pair of parallel spaced channels extending parallel to, and below said top face, for receiving respective ribs depending from the mounting flange of said first connector.

* * * * *

UNITED STATES PATENT AND TRADEMARK OFFICE

CERTIFICATE OF CORRECTION

PATENT NO. : 5,044,984

DATED : September 3, 1991

INVENTOR(S) : Bruce Mosser, et al.

It is certified that error appears in the above-identified patent and that said Letters Patent is hereby corrected as shown below:

Claim 1, column 6, line 56, please delete "amounting" and insert --a mounting--.

Claim 2, column 7, line 6, please delete "and" and insert --an--.

Claim 13, column 7, line 59, please delete "Wherein" and insert --wherein--.

Claim 25, column 9, line 37, please delete "fist" and insert --first--.

Claim 26, column 10, line 25, please delete "amounting" and insert --a mounting--.

Signed and Sealed this

Ninth Day of February, 1993

*Attest:*

STEPHEN G. KUNIN

*Attesting Officer*

*Acting Commissioner of Patents and Trademarks*